United States Patent [19]

Einstabland

[11] Patent Number: 4,484,841

[45] Date of Patent: Nov. 27, 1984

[54] OFFSHORE PLATFORM STRUCTURE FOR ARTIC WATERS

[75] Inventor: Thomas Einstabland, Asker, Norway

[73] Assignees: Ingeniør Thor Furuholmen A/S; A/S Høyer-Ellefsen; Ingeniør F. Selmer A/S, all of Oslo, Norway

[21] Appl. No.: 353,352

[22] Filed: Mar. 1, 1982

[30] Foreign Application Priority Data

Sep. 2, 1980 [NO] Norway ..... 802586

[51] Int. Cl.[3] ..... E02B 3/22; E02D 21/00

[52] U.S. Cl. ..... 405/212; 405/195; 405/207; 405/217

[58] Field of Search ..... 405/195, 207, 210–212, 405/217, 229, 216; 52/167

[56] References Cited

U.S. PATENT DOCUMENTS

| | | | |
|---|---|---|---|
| 2,002,934 | 5/1935 | Collins | 52/167 |
| 3,748,800 | 7/1973 | Glicksberg | 52/167 |
| 3,793,840 | 2/1974 | Mott . | |
| 3,921,558 | 11/1975 | Redshaw | 405/210 X |
| 4,102,144 | 7/1978 | Anders | 405/211 |
| 4,106,301 | 8/1978 | Gerwick | 52/167 X |
| 4,191,495 | 3/1980 | Rivacoba et al. | 52/167 X |
| 4,215,952 | 8/1980 | Baardsen | 405/211 |

FOREIGN PATENT DOCUMENTS

| | | | |
|---|---|---|---|
| 675137 | 7/1979 | U.S.S.R. | 52/167 |

*Primary Examiner*—Cornelius J. Husar
*Assistant Examiner*—Nancy J. Stodola
*Attorney, Agent, or Firm*—Fleit, Jacobson, Cohn & Price

[57] ABSTRACT

An offshore platform structure of the gravity type intended to be installed on a sea bed in artic or corresponding waters. The platform structure comprises a substructure intended to be completely submerged and supported by the sea bed when in installed position, a superstructure extending up from the substructure and up above the sea bed and a deck superstructure supported by the superstructure above the sea level. A fender is provided intended to protect the superstructure against drifting ice and icebergs, the substructure being provided with a preferably horizontal top support slab supporting the fender, the fender being movably arranged on said support slab and comprising a preferably compartmented cylindrical ring-shaped body with a large weight resting preferably freely on the substructure, intended to be arranged apart from the superstructure when in normal position.

13 Claims, 5 Drawing Figures

Fig.1
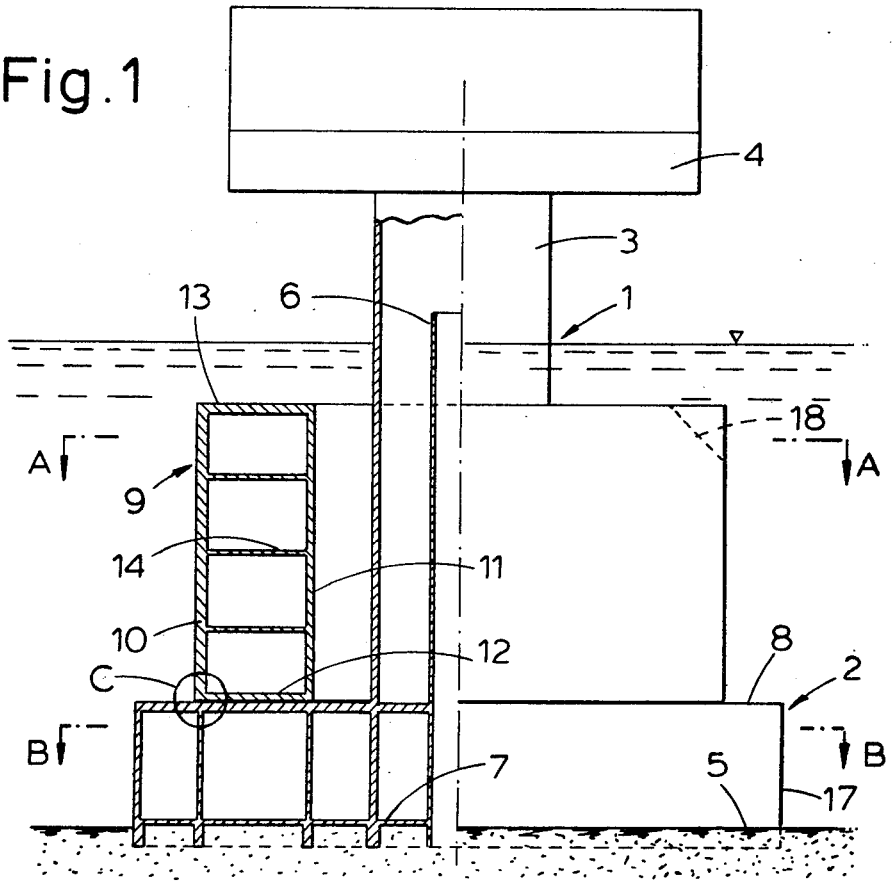
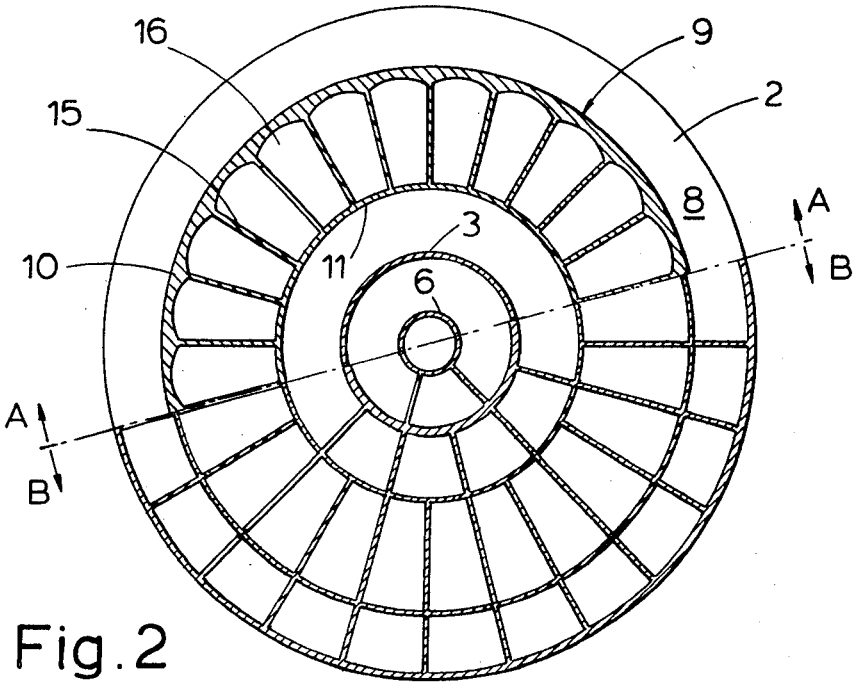
Fig.2

OFFSHORE PLATFORM STRUCTURE FOR ARTIC WATERS

FIELD OF THE INVENTION

The present invention relates to an offshore platform structure intended to be installed on a sea bed in artic waters or in waters where drifting ice-bergs may occur. Consequently, the platform structure may be exposed to accidental ice-berg impacts. The platform structure according to the present invention is preferably a gravity type structure, comprising a substructure intended to be fully submerged when installed on the sea bed, a superstructure projecting up from the substructure, extending up above the sea level and a deck superstructure, supported by the superstructure above the sea level. The platform structure is particularily, but not exclusively suitable to be used as a drilling, production storage of hydrocarbons and/or as an accommodation platform. According to the present invention the platform structure is further equipped with one or more protection means, protecting vital parts of the platform against any direct iceberg impacts.

PURPOSE OF THE INVENTION

One main object of the present invention is to provide a gravity platform, fixed to the sea bed, which is capable of withstanding considerably higher iceberg impact energies than the conventional platform strutures. It should be appreciated that drifting icebergs represent enormous amount of energy which in case of an impact with a platform must be absorbed by the platform without causing lateral displacement of the platform or causing failure of the main structural members of the platform or failure of critical components on the structure.

SUMMARY OF THE INVENTION

According to the present invention the vital parts of the superstructure are enclosed within a heavy ring-shaped fender, thereby being protected against any direct iceberg impact. The fender is movably arranged with respect to the substructure and the superstructure, the fender preferably resting on top of the substructure. The sliding resistance of the fender shall be sufficiently high to ensure the platform will behave as one stiff structure when exposed to extreme environmental loads caused by wave, wind and current, i.e. the so-called "100-years" conditions, and the more frequent iceberg impact conditions. During normal conditions and conditions described above, the platform according to the present invention, including the ring-shaped fender, will be equivalent to that of a conventional fixed gravity platform.

If exposed to excessive accidental iceberg impacts, the fender shall slide along the upper surface of the platform substructure, the impact energy being absorbed as friction (heat) energy in the fender supports. By the sliding of the fender, the ultimate iceberg impact loads are effectively reduced, thereby reducing the risk for overloading the platform structure and the foundation. The sliding of the fender does not interfere with the functional operations of the platform. After sliding, the original fender position can be restored by removing ballast until the fender floats off the platform substructure.

The design of the platform is based on "weak link" principle, implying that sliding of the fender shall occur for a horizontal load significantly lower than a load causing main structural member of foundation soil failure. The platform is designed to safely absorb 85% of the impact energy of the most extreme accidental iceberg impact condition, i.e. a so-called "100-year" iceberg impact. An improved iceberg impact resistance may be obtained by increasing the lateral gap between the fender and the superstructure. In addition or optionally, increased resistance may be obtained by increasing the weight of the fender and/or improving the friction between the base plate of the fender and the top surface of the substructure.

A platform according to the present invention may for example carry a total topside weight of 40,000 tons during platform towout.

The platform structure comprises preferably a substructure intended to rest on the sea bed and to be completely submerged when installed on the offshore site and a superstructure extending up from the substructure and up above the sea level, supporting a deck superstructure. The superstructure comprises a plurality of contiguous cells extending centrally up from the foundation slab up to the elevation of the deck superstructure. The deck is preferably resting directly on the superstructure.

Further, the substructure comprises a plurality of contiguous cells. The platform is resting on a preferably circular foundation pad composed for example of an upper and lower horizontal slab and a number of radial diaphragm walls. A circumferential wall underneath the fender supports provides the outer boundary of the vital parts of the platform substructure. This circumferential wall may be inside the outer periphery of the fender, thus being protected against any iceberg impact. The compartments on the outside of the circumferential wall primarily serve as buoyancy chambers during platform construction to facilitate the construction of the fender. Subsequent to the platform installations, the compartments are used for solid ballast storage. Iceberg impact damage to these compartment walls will not affect the safety of the platform or interfere with platform operations. The outer walls of these ballast cells may be designed to yield a low impact load resistance so as to reduce the magnitude of any impact loads transmitted to the more vital parts of the platform substructure. If a majority of said base ballast compartments become damaged, resulting in a significant loss of solid ballast, the platform geotechnical safety may be restored by filling stones or gravel on the sea bed surrounding the platform.

The foundation base slab may be equipped with ribs, for instance of height 0.5 meter to prevent the base slab being exposed to high local soil pressure during platform installation.

As previously pointed out the purpose of the fender is to protect the more vital parts of the platform structure against iceberg impact damage and to limit the magnitude of any accidental iceberg impact load. The fender is a ring-shaped structure comprising an outer and inner cylindrical vertical walls and a plurality of diaphragm walls. The lower part of the fender is preferably strengthened by a heavy base plate which shall transmit the fender support reactions. The outer wall is preferably reinforced by a member of radially protruding vertical "teeths", fins, ribs etc. in order to reduce the excessive impact forces and to improve distribution of the loads along the periphery of the fender. The fender is preferably terminated 5 meters above the middle water line.

The fender is resting on a frictional support means, for example consisting of a number of discrete steel friction bearings affixed to the platform substructure. Fender sliding resistance is attained through surface to surface friction between the steel supports and the fender concrete base plate. This alternative is proposed for simplicity reasons and to ensure adequate cooling of the supports if and when sliding occur. Alternative type of fender support such as for example a gravel bed may be used.

Extensive compartmentation of both the substructure, superstructure, and the fender ensure the platform afloat will have satisfactory damage stability. Extensive use of prestressing ensures the structural integrity of both the substructure, superstructure and the fender.

The fender, when deballasted, i.e. when solid and/or water ballast is removed, shall have sufficient buoyancy to float clear off its sliding support to enable the original fender position to be restored. Positive contact pressure should further be maintained along the whole circumference of the fender supports for both extreme environmental and iceberg loading conditions.

The fender sliding resistance is attained as friction between the top surface of the substructure and the underside of the concrete base plate of the fender. The fender sliding resistance is the product of the fender net submerged weight and the friction coefficient for the support.

The lower part of the fender base plate may be made up of precast concrete elements to ensure the required surface characteristics, e.g. roughness and construction tolerances can be attained. Steel fiber reinforcement and good quality aggregates are assumed used to obtain a high abrasion resistance of the outer concrete skin.

If discrete disk-shaped supports are used to attain sliding resistance, the top surface of these steel disks may preferably have a slight spherical curvature to prevent the fender be riding on the edge of the support. Such proposed design allows the fabrication of the steel supports be completed before delivery, thereby reducing the amount and complexity of the work peformed at the platform site. If deemed necessary, a laminate of specially designed material may be attached to the top surface of the steel supports, to attain the required friction characteristics. The fender support should be capable of producing a constant friction resistance independent of the sliding displacement. After sliding, the chosen fender support design should enable adjustment of the fender position. High abrasion resistance of the sliding surface is preferable.

An alternative support design includes a continuous steel support along the entire periphery of the fender and a fender support design utilizing the internal coefficient of friction of a cohesionless material, e.g. uniform sand.

BRIEF DESCRIPTION OF THE DRAWINGS

One preferred embodiment of the present invention will now be described in further detail with reference to the attached drawings, wherein:

FIG. 1 shows a vertical elevation view, partly in section of one embodiment of the platform according to the present invention, and FIG. 2 shows a horizontal section of the embodiment shown in FIG. 1 along line A—A and partly along line B—B in FIG. 1.

DESCRIPTION OF THE PRESENTLY PREFERRED EMBODIMENT

Figure 3:
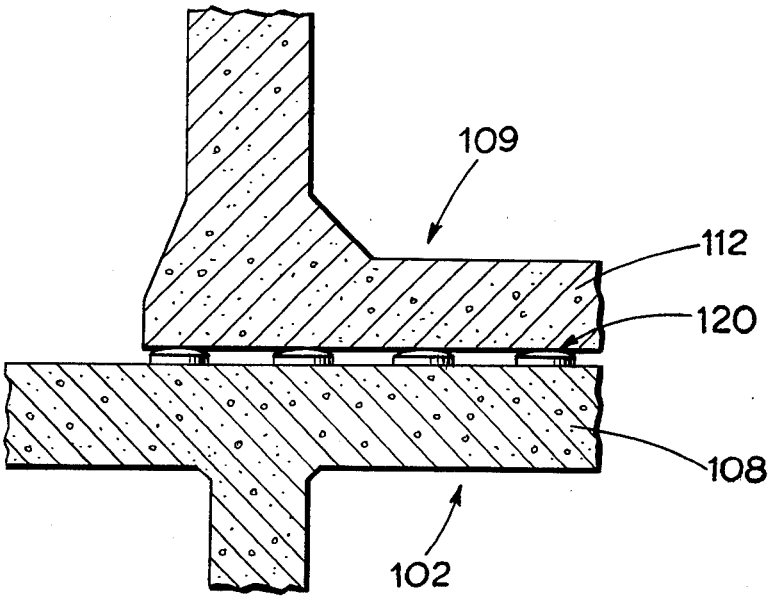
FIGS. 3, 3*a* and 4 show the details of circle C in FIG. 1.

The platform 1 according to the embodiment shown in the Figures comprises a substructure 2, a superstructure 3 and a deck superstructure 4. The platform 1 has a circular cross-sectional area. The superstructure 3 comprises a plurality of contiguous cells which are centrally arranged with respect to the substructure. The superstructure may, however, be formed of separate columns, the longitudinal axis of which preferably are lying on a circle, co-axially arranged with respect to the center axis of the substructure 2. It should be appreciated that the cross-sectional area of the substructure not necessarily be circular, but may have any suitable shape, such as polygonal.

The platform is of the gravity type, having a substructure 2 resting on the sea bed 5 when in installed position. The columns forming the superstructure are hollow, incorporating a central cell 6 extending from the base plate 7 of the substructure and up to the deck superstructure 4. The cell 6 contains conductors, J-tubes and various types of accessories, etc.

The substructure 2 is provided with a horizontal upper plate or slab 8, supporting a ring-shaped fender structure 9. The fender 9 is formed as a relatively high cylindrical ring, comprising an outer wall 10 and an inner wall 11 arranged apart and interconnect by a plurality of horizontal and/or diaphragm walls 14. At its upper end the cylindrical ring is terminated by a horizontal top plate 13, while at its lower end the fender is terminated by a horizontal base plate 12.

FIG. 2 shows a horizontal section of the platform structure shown in FIG. 1, the upper half of the drawing showing a section seen along line A—A while the lower half shows a section seen along line B—B in FIG. 1. Correspondingly, the left half of FIG. 1 shows a section along line A—A in FIG. 2, while the half on the right hand side shows a vertical elevation of the platform according to the present invention.

As shown in FIG. 1 the fender 9 is divided into several compartments 16 both in vertical and horizontal direction by means of horizontal walls 14 and/or a plurality of vertical walls 15 arranged in radial direction as shown in FIG. 2. The substructure 2 is correspondingly divided into several compartments by a corresponding wall system.

Both the platform structure 1 and the fender 9 are provided with means for supplying and/or removing ballast from the compartments 16. Sea water and/or solid materials such as sand or gravel may be used as ballast.

The outer diameter of the fender 9 is considerably less than that of the substructure, while the radial distance between the superstructure 3 and the inner wall of the fender 9 approximately corresponds to the distance between the external wall 17 of the substructure 2 and the external wall 10 of the fender 9 when the latter is in its original co-axial position on the substructure 2. The fender should preferably extend from the substructure 2 and above the sea level. The fender 9 may, however, be terminated at a level below the sea level, the height of the fender 9 being dependent on the height of the superstructure and the height of the maximum appearing iceberg, bearing in mind that 8/9 of the height of the iceberg is below the sea level, and that the fender 9 shall protect the platform structure from drifting in on the sea level. Consequently, the fender 9 should preferably extend up above the sea level. The top surface may be frusto-conical as indicated by the dotted line 18 in FIG. 1.

The impact energy absorbed by the fender and transferred into kinetic energy and heat caused by friction due to relative motion between the fender and the top surface of the substructure 2. Consequently, said two surfaces should be designed so as to give as high friction as possible between the top slab 8 of the substructure and the base bottom slab 12 of the fender 9.

According to the embodiment shown in the Figures, said increased friction is achieved either by arranging disk-shaped supports of steel attached to the platform substructure or the underside of the concrete base plate of the fender. Alternatively, a layer of gravel of height up to ½ meter arranged on top of the substructure may be used to increase the friction.

When an iceberg collides with the fender 9, the fender 9 will be forced laterally along the top 8 of the substructure 2 towards the superstructure 3, the impact energy being absorbed as friction and heat energy in the fender supports. If the impact defeat operation is peformed successfully, the motion of the iceberg in direction of collision is brought to cease and/or the direction of motion is changed so that the iceberg drifts past the platform. Subsequent to the collision, ballast is removed from the fender to an extent necessary to enable the fender to float clear off the substructure. The fender 9 is then moved back to its original position and lowered down on to the substructure by adding ballast to the fender. The fender 9 may be moved back to its original position by means of winches, wires, jacks, etc.

If the fender 9 is of a type which does not extend up above the sea level, the fender may be provided with one or more tubes extending up above the sea level to enable access to the fender and/or containing pipes etc. for manipulating the ballast.

In order to increase the resistance of motion, the substructure 2 may be provided with protruding dowels projecting up from the substructure into the space between the substructure 2 and the fender 9. The dowels may be reinforced.

The fender 9 may be dimensioned such that its outer wall(s) will collapse locally and/or that its inner walls will collapse locally if the fender is moved laterally into engagement with the superstructure 3 and the iceberg still is forcing the fender against the superstructure.

The top surface of the substructure and the surface of the base plate of the fender may be provided with an uneven surface so as to increase the resistance against motion. The fender 9 is dimensioned and given such a weight that it will not be moved when subjected to the wave loads and the frequently appearing ice drifting on the surface. The superstructure 3 may of course have any suitable shape without deviating from the present invention.

In FIG. 3, the top of the substructure is denoted by 108 and the base bottom slab of the fender 109 is denoted 112. A plurality of disk-shaped supports of steel are provided on the top surface of the top slab 108 of the substructure 102. The disks 120 are shaped with spherical top surfaces contacting the bottom surface of the bottom 112 of the fender 109.

Figure 3A:
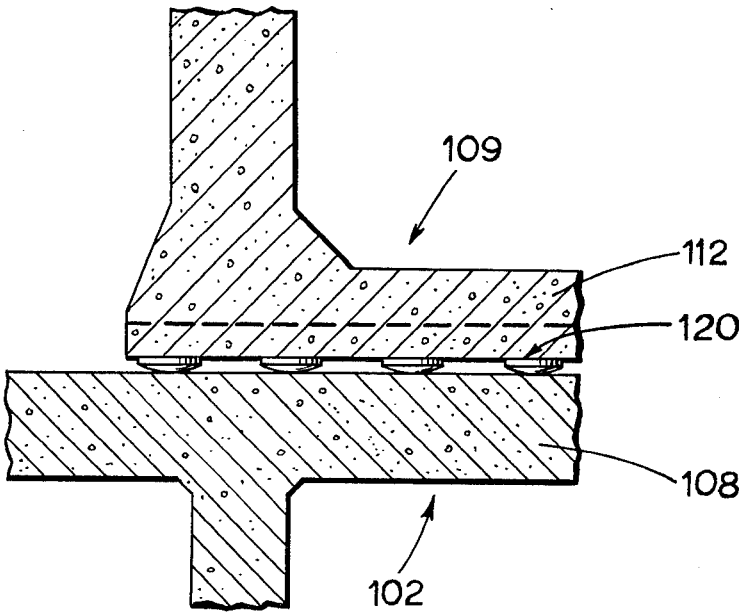

FIG. 3*a* shows an embodiment rather identical with that of FIG. 3, however, with the support disks 120 arranged on the bottom surface of the bottom 112 of the fender 109 and having their spherical bottom surfaces directed against the top 108 of the substructure 102.

Figure 4:
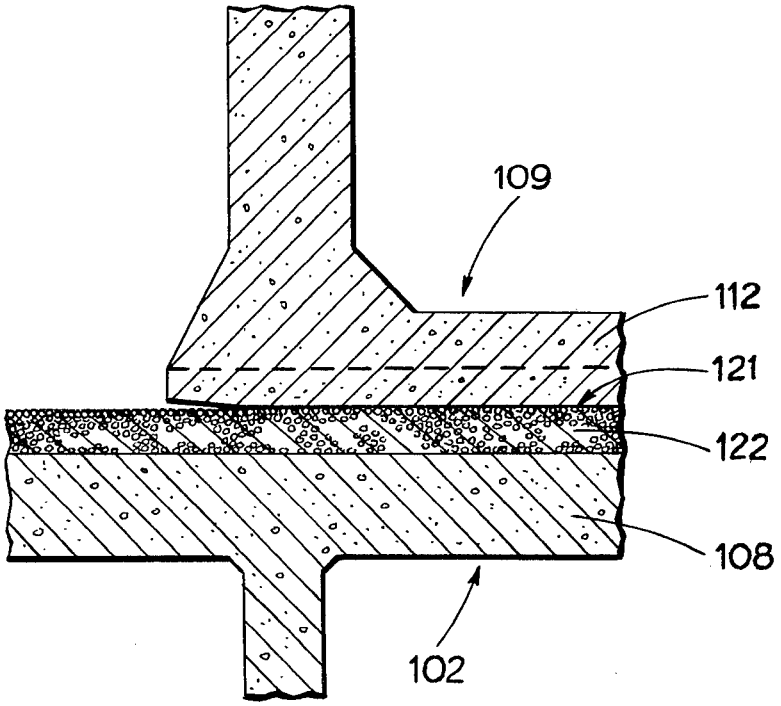

FIG. 4 shows the same detail C of FIG. 1 according to another embodiment wherein a layer of crushed rock or gravel 122 is provided between the bottom surface 121 of the fender bottom 112, and the top 108 of the substructure 102. The peripheral portion of the bottom surface 121 is chamfered slightly upwardly to prevent the peripheral edge of the fender bottom 112 from pushing the rock or gravel away in front of it when being displaced by an iceberg or the like.

According to the present invention at least the lower section of the substructure is construted in a dry dock, preferably using the slip forming technique. Dependent on the height of the substructure the entire substructure with its top slab and optionally the base slab and the lower section of the fender and the superstructure may be constructed in the dry dock. Water is then pumped into the dry dock, its walls removed and the raft is towed to a deep water side where the remaining portions are cast, preferably using slip forms.

The deck superstructure may either be built in situ or constructed somewhere else, transported on barges and mounted in the well established manner as used for "Condeep" ® gravity platforms.

What we claim is:

1. An offshore concrete gravity platform structure for installaion on a sea bed in artic waters, said platform comprising:

a substructure completely submerged and adapted to be supported by the sea bed when in an installed position, a superstructure extending up from the substructure, a deck supported by said superstructure, said deck being above the sea water surface, said substructure having a top, said top supporting a fender, said fender comprising a cylindrical ring-shaped body located concentrically with said superstructure, means to ballast said fender for resting said fender on said substructure, said fender to be displaced relatively to said substructure and said superstructure when impacted by large iceberg masses and thus protecting said substructure and said superstructure.

2. An offshore platform structure as claimed in claim 1, wherein an outer diameter of said fender is less than an outer diameter of said substructure.

3. An offshore platform structure as claimed in claim 1, wherein the cylindrical ring-shaped fender body comprises an outer wall, an inner wall, and a plurality of partition walls rigidly interconnecting said outer and inner walls.

4. An offshore platform structure as claimed in claim 3, wherein an inner wall of the fender is thinner and weaker than an outer wall of the fender, said inner wall to collapse first in an impact against the superstructure upon collision with an iceberg by said outer wall and displacement of said fender towards the superstructure.

5. An offshore platform structure as claimed in claim 1, wherein a frictional support means is provided between the fender and the substructure.

6. An offshore platform structure as claimed in claim 5, wherein the frictional support means comprises a layer of crushed rocks or gravel.

7. An offshore platform structure as claimed in claim 5, wherein the frictional support means comprises a plurality of interspaced steel friction supports affixed to the top of the substructure.

8. An offshore platform structure as claimed in claim 5, wherein the frictional support means comprises a plurality of interspaced disk-shaped supports affixed to a bottom surface of the fender, the supports having a spherical bottom surface facing the top of the substructure.

9. An offshore platform structure as claimed in claim 1, wherein the fender is shaped as a continuous ring.

10. An offshore structure as claimed in claim 18, wherein said fender has a frusto-conical upper end.

11. An offshore platform as claimed in claim 1, wherein the fender is provided with a substantially horizontal bottom slab.

12. An offshore platform as claimed in claim 1, wherein said cylindrical ring body has plurality of compartments.

13. An offshore platform as claimed in claim 1, wherein said ring body rests freely on said substructure.

* * * * *